US011732326B1

(12) United States Patent
Duyvesteyn

(10) Patent No.: US 11,732,326 B1
(45) Date of Patent: Aug. 22, 2023

(54) EXTRACTION OF LITHIUM FROM MUDSTONE AND SEQUESTRATION OF CARBON DIOXIDE

(71) Applicant: Extractive Metallurgy Consultancy, LLC, Reno, NV (US)

(72) Inventor: Willem P. C. Duyvesteyn, Reno, NV (US)

(73) Assignee: EXTRACTIVE METALLURGY CONSULTANCY, LLC, Reno, NV (US)

( * ) Notice: Subject to any disclaimer, the term of this patent is extended or adjusted under 35 U.S.C. 154(b) by 0 days.

(21) Appl. No.: 18/166,457

(22) Filed: Feb. 8, 2023

(51) Int. Cl.
*C22B 26/12* (2006.01)
*C22B 3/06* (2006.01)

(52) U.S. Cl.
CPC ..... *C22B 26/12* (2013.01); *C22B 3/06* (2013.01)

(58) Field of Classification Search
CPC ..... C22B 26/12; C22B 3/06
USPC ..... 423/179.5
See application file for complete search history.

(56) References Cited

U.S. PATENT DOCUMENTS 3,586,487 A 6/1971 Juhasz
7,824,453 B2 11/2010 Duyvesteyn
7,909,985 B2 3/2011 Hong
8,658,029 B2 2/2014 Duyvesteyn
8,753,594 B1 6/2014 Burba
10,012,020 B2 7/2018 Li
10,150,056 B2 12/2018 Snydacker
10,626,020 B2 4/2020 Reed
11,012,017 B2 5/2021 Nannen
11,102,022 B2 8/2021 Brooks
11,122,010 B2 9/2021 Jobson
11,132,017 B2 9/2021 Strong
11,152,019 B2 10/2021 Fontana
11,242,022 B2 2/2022 Umezawa
11,365,128 B2 6/2022 Marston
11,396,452 B2 7/2022 Riabtsev
11,534,748 B2 12/2022 Brown
2011/0030586 A1 2/2011 Constantz
2011/0298270 A1 12/2011 Duyvesteyn
2013/0106117 A1 5/2013 Sites
2019/0276328 A1 9/2019 Lazerson
2020/0308947 A1 10/2020 Willson
2020/0399735 A1 12/2020 Sams
2021/0207243 A1* 7/2021 Sun ..... C22B 3/04
2022/0055910 A1 2/2022 Jariwala
2022/0356545 A1 11/2022 Popovs
2022/0372594 A1* 11/2022 Chon ..... C01D 7/00

* cited by examiner

*Primary Examiner* — Melissa S Swain
(74) *Attorney, Agent, or Firm* — Schneer IP Law; Ryan Schneer

(57) ABSTRACT

Embodiments of the present disclosure may include method for extracting lithium from a mudstone ore. Embodiments of the present disclosure may also include a method for extracting lithium from a mudstone formation and sequestering carbon dioxide into the mudstone formation in situ.

19 Claims, 5 Drawing Sheets

EXTRACTION OF LITHIUM FROM MUDSTONE AND SEQUESTRATION OF CARBON DIOXIDE

FIELD

The field of the present disclosure relates to lithium extraction, specifically to the extraction of lithium from mudstone formations and carbon dioxide sequestration within these formations.

BACKGROUND

Lithium occurs in potentially economic concentrations in three types of deposits: pegmatites, continental brines, and clays. Lithium is currently produced from pegmatites and brines, with brines being the largest source of lithium worldwide. However, there is no active mining of lithium from mudstone deposits. Consequently, methods of extracting lithium from mudstone deposits are needed.

SUMMARY

Embodiments of the present disclosure may include a method for extracting lithium from mudstone ore. In some examples, the method includes obtaining mudstone ore. In some examples, the method includes combining the mudstone ore with a reagent solution to obtain a slurry. The method may also include mixing the slurry with supercritical carbon dioxide to form hydronium ions and bicarbonate ions, thereby extracting lithium ions from a solid slurry into an aqueous phase of the slurry. The method may also comprise reacting the lithium ions with the bicarbonate ions to form lithium bicarbonate. In some examples, the solid phase may be removed from the slurry to obtain a lithium bicarbonate solution.

Embodiments of the present disclosure may also include a method for extracting lithium from a mudstone formation and sequestering carbon dioxide into the mudstone formation in situ. The method may include obtaining mudstone ore in situ from the mudstone formation. A reagent solution may be injected into the mudstone formation to form a reagent-mudstone suspension. In specific examples, the method may comprise mixing the reagent-mudstone suspension with supercritical carbon dioxide to form hydronium ions and bicarbonate ions, thereby lithium ions from a solid phase of the reagent-mudstone suspension into an aqueous phase of the reagent-mudstone suspension. Some implementations may include reacting the lithium ions with the bicarbonate ions to form lithium bicarbonate. In some examples, the aqueous phase may be removed from the mudstone formation to obtain a solution, including the lithium bicarbonate. Carbon dioxide may also be sequestered into the solid phase of the mudstone formation in some embodiments.

Covered embodiments are defined by the claims, not this summary. This summary is a high-level overview of various aspects and introduces some of the concepts that are further described in the Detailed Description section below. This summary is not intended to identify key or essential features of the claimed subject matter, nor is it intended to be used in isolation to determine the scope of the claimed subject matter. The subject matter should be understood by reference to appropriate portions of the entire specification, any or all drawings, and each claim.

BRIEF DESCRIPTION

Some embodiments of the disclosure are herein described, by way of example only, with reference to the accompanying drawings. With specific reference now to the drawings in detail, it is stressed that the embodiments shown are by way of example and for purposes of illustrative discussion of embodiments of the disclosure. In this regard, the description taken with the drawings makes apparent to those skilled in the art how embodiments of the disclosure may be practiced.

DETAILED DESCRIPTION

Figure 1:
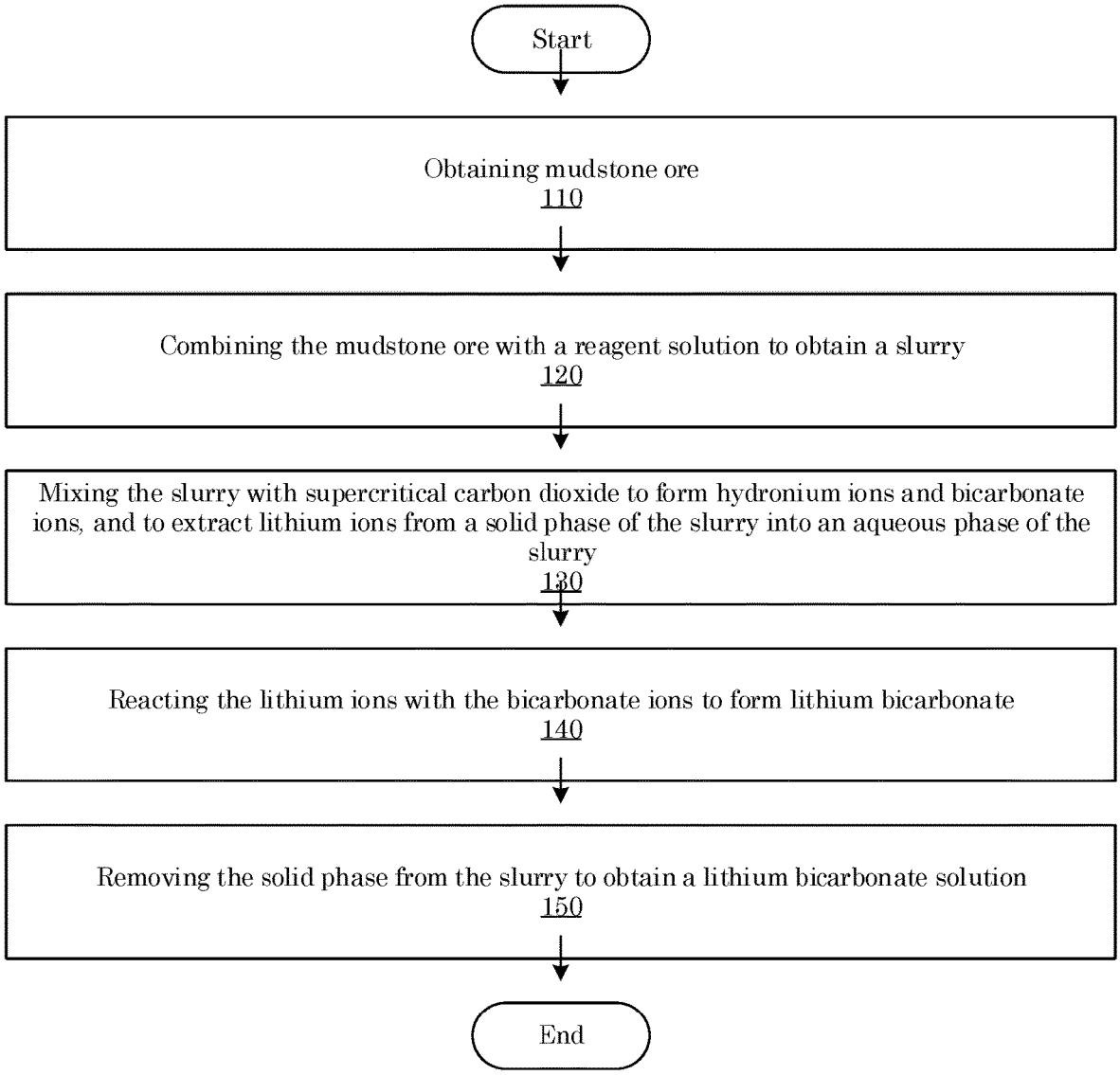
FIG. 1 is a flowchart illustrating a method for extracting lithium according to some embodiments of the present disclosure.

FIG. 1 is a flowchart describing a non-limiting example of a method for extracting lithium from a mudstone ore, according to some embodiments of the present disclosure. The mudstone ore may be obtained from a mudstone formation. As used in the present disclosure, "mudstone" is a type of sedimentary rock, including clay-sized particles and silt-sized particles that have been compacted into solid rock that is not laminated or fissile. The term "mudstone" in the present disclosure is meant to encompass "claystone," a sedimentary rock formed from compacted clay-sized particles. "Claystone" often has a fine-grained texture and can be either soft and easily broken or hard and brittle. Examples of "mudstone" include, but are not limited to, shale, siltstone, argillite, greywacke, diamictite, phyllite, marlstone, tainiolite, smectite, illite, packstone, grainstone, or any combination thereof.

In some embodiments, at 110, the method may include obtaining mudstone ore from the mudstone formation. In some embodiments, the mudstone ore has an average particle size of 500 microns or less, 400 microns or less, 300 microns or less, 200 microns or less, 100 microns or less, 50 microns or less, 25 microns or less, 10 microns or less, 5 microns or less, 1 micron or less, or any combination thereof. In some embodiments, the mudstone ore has an average particle size of 1 micron to 500 microns, 5 microns to 500 microns, 10 microns to 500 microns, 25 microns to 500 microns, 100 microns to 500 microns, 400 microns to 500 microns, 1 micron to 400 microns, 1 micron to 100 microns, 1 micron to 50 microns, 1 micron to 25 microns, 1 micron to 10 microns, 1 micron to 5 microns, 5 microns to 100 microns, 10 microns to 25 microns, 10 microns to 50 microns, 25 microns to 50 microns, or any combination thereof.

In some embodiments, size reduction steps transform the mudstone into a mudstone ore. In other embodiments, however, the mudstone ore is obtained from the formation with an average size within at least one of the above particle size ranges due to the natural grain size of the ore. In some such embodiments, size reduction steps may be excluded, but size reduction equipment may be used to defragment or break the ore.

In some embodiments, before step 110, the mudstone ore may be obtained by: mining mudstone and defragmenting the mudstone to form the mudstone ore. In some examples, defragmenting the mudstone to form the mudstone ore comprises breaking the mudstone to form the mudstone ore; and disaggregating the mudstone ore. In some examples, at least one of the processing steps above (e.g., defragmenting, breaking, disaggregating, or any combination thereof) may be performed using: a hammer drill, jackhammer, demolition hammer, cone crusher, rotary cutter, hydraulic splitter, chipping hammer, grinder, milling machine, trencher, rotary attritor, saw crusher, cone crusher, impact crusher, gyratory crusher, hammer mill, roller mill, rod mill, ball mill, vibratory mill, centrifugal mills, grinder, classifier, screen, sizer, or separator, or any combination thereof. In some examples, mudstone residue from the above processing steps may be used for sequestration of carbon dioxide, as described in more detail below.

At 120, the method may include combining the mudstone ore with a reagent solution to obtain a slurry. In some examples, the reagent solution comprises sodium, potassium, magnesium, water, at least one acid, at least one base, or any combination thereof. The slurry may comprise 20% to 60% solids, 30% to 60% solids, 40% to 60% solids, 50% to 60% solids, 20% to 50% solids, 20% to 40% solids, 20% to 30% solids, 30% to 60% solids, 40% to 60% solids, 50% to 60% solids, 30% to 50% solids, 30% to 40% solids, 40% to 50% solids, or any combination thereof. In some examples, the slurry may comprise a solid phase and an aqueous phase.

In some examples, before mixing with supercritical carbon dioxide (as described below), the slurry is preheated to a temperature of 45° C. to 95° C., 55° C. to 95° C., 65° C. to 95° C., 75° C. to 95° C., 85° C. to 95° C., 45° C. to 85° C., 45° C. to 75° C., 45° C. to 65° C., 45° C. to 55° C., 55° C. to 65° C., 45° C. to 55° C., or any combination thereof.

Figure 3:
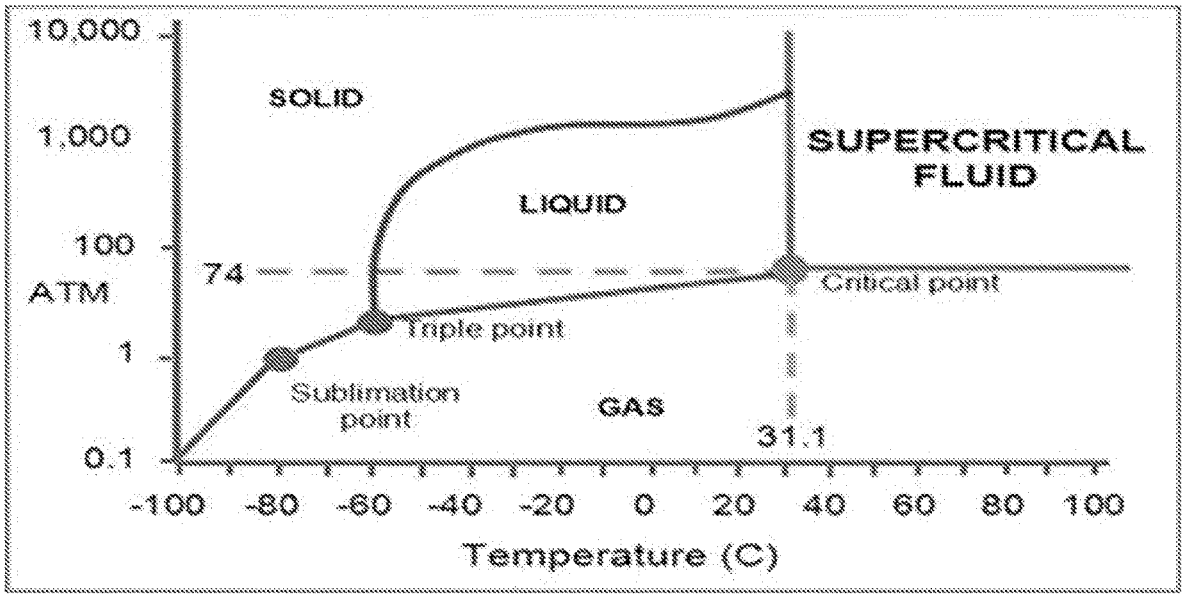
FIG. 3 is a phase diagram of carbon dioxide.

At 130, the method may include mixing the slurry with supercritical carbon dioxide to form hydronium ions and bicarbonate ions and to extract lithium ions from a solid phase of the slurry into an aqueous phase of the slurry. As used herein, "supercritical carbon dioxide" is a state of carbon dioxide where the pressure and temperature are above the critical point of 31.1° C. and 73.8 bar. Examples of suitable temperatures and pressures for the supercritical carbon dioxide of the present disclosure are depicted in the phase diagram of FIG. 3.

In some examples, the slurry and supercritical carbon dioxide mixing is performed using an autoclave, such as, but not limited to, a compartmentalized, mechanically agitated autoclave. In specific examples, the slurry and supercritical carbon dioxide is mixed using a tube digester. A "tube digester" is a vessel used in the aluminum industry to digest bauxite ore. One non-limiting example of a suitable tube digester is provided in U.S. Pat. No. 3,586,487, which is incorporated by reference for all purposes.

In certain examples, the mixing of the slurry with supercritical carbon dioxide is performed for 15 minutes to 240 minutes, 30 minutes to 240 minutes, 60 minutes to 240 minutes, 90 minutes to 240 minutes, 120 minutes to 240 minutes, 150 minutes to 240 minutes, 180 minutes to 240 minutes, 210 minutes to 240 minutes, 15 minutes to 210 minutes, 15 minutes to 180 minutes, 15 minutes to 150 minutes, 15 minutes to 120 minutes, 15 minutes to 90 minutes, 15 minutes to 60 minutes, 15 minutes to 30 minutes, 30 minutes to 210 minutes, 60 minutes to 180 minutes, 90 minutes to 150 minutes, 90 minutes to 120 minutes, 120 minutes to 150 minutes, or any combination thereof.

In some non-limiting embodiments during the mixing of the slurry with supercritical carbon dioxide, the slurry is maintained at a temperature of at least 32° C., at least 42° C., at least 52° C., at least 62° C., at least 72° C., at least 82° C., at least 92° C., or any combination thereof; and pressure of at least 75 bar, at least 85 bar, at least 95 bar, at least 105 bar, at least 115 bar, at least 125 bar, or any combination thereof.

In some examples, lithium ions from the solid phase of the slurry are extracted into an aqueous phase of the slurry by leaching the slurry with the supercritical carbon dioxide. Leaching may include mixing the supercritical carbon dioxide with a reagent solution to form a "wet" supercritical carbon dioxide solution. The wet supercritical carbon dioxide solution can then be injected into the slurry, which causes the lithium ions to dissolve into the aqueous solution. The reagent solution may comprise sodium, potassium, magnesium, water, at least one acid, at least one base, or any combination thereof. A non-limiting example of a leaching process that may be employed in conjunction with the present disclosure is described in United States Patent Application No. 2021/0207243, which is incorporated by reference in its entirety for all purposes.

In some examples, intercalation extracts lithium ions from the solid phase of the slurry into an aqueous phase. As defined herein, "intercalation" is a process where supercritical carbon dioxide enters at least one layer of the solid phase of the slurry or—in the in situ embodiment below, at least one layer of the reagent-mudstone suspension. A non-limiting method of intercalation may include bubbling the supercritical carbon dioxide into the slurry or injecting the supercritical carbon dioxide into a reagent-mudstone suspension in the mudstone formation.

Figure 4:
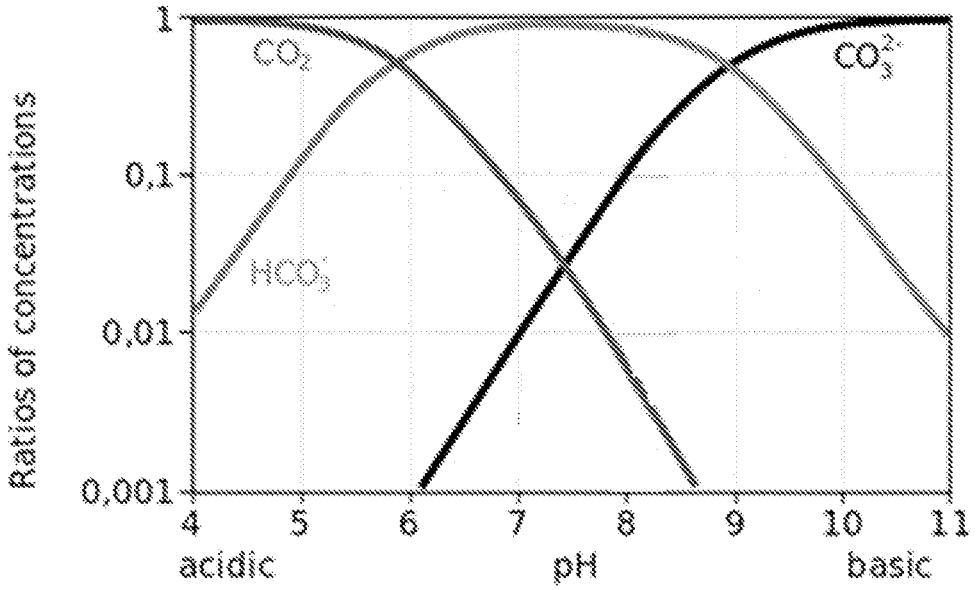
FIG. 4 is a pH diagram of carbon dioxide.

Intercalation may be performed at a pH range where bicarbonate ions and aqueous carbonic acid (i.e., carbonic acid or $H_2CO_3$) are present in a sufficiently high concentration, as shown in the pH diagram of FIG. 4. One example of a suitable pH range would be a pH of 5-7. At the suitable pH range, carbonic acid dissociates into bicarbonate and hydrogen ions according to $H_2CO_3 \Leftrightarrow H^+ + HCO_3^-$. The hydrogen ion will form hydronium ions according to $H^+ + H_2O \Leftrightarrow H_3O^+$. These reactions would then trigger the following phase transition $H_3O^+_{aqueous\ phase} + Li^+_{solid\ phase} \rightarrow H_3O^+_{solid\ phase} + Li_{aqueous\ phase}$, which can result in the lithium ions being extracted into an aqueous phase of the slurry and further results in hydronium ions being intercalated into the solid phase.

In some examples, while water molecules are intercalated, the application of the supercritical carbon dioxide will result in the rejection of some of the intercalated water that will be replaced by intercalated $CO_2$. The intercalation of $CO_2$ may perform multiple functions. The intercalated $CO_2$ can increase the relative amount of bicarbonate ions in the solution, which will cause the lithium ions to form lithium bicarbonate over the less soluble lithium carbonate preferentially. The intercalation of $CO_2$ may also be used in the in situ embodiments as a mechanism for sequestration.

At 140, the mixing may include reacting the lithium ions with the bicarbonate ions to form lithium bicarbonate. Lithium bicarbonate formation may occur through the following reaction $Li^+_{aqueous\ phase} + HCO_3^-{}_{aqueous\ phase} \Leftrightarrow LiHCO_3{}_{aqueous\ phase}$. In some examples, the reaction is performed at a pH range of 5-7, 5-6, 6-7, or any combination thereof. In some examples, the pH may need to be adjusted with an inorganic acid to maintain this range. Hydrochloric, sulfuric, nitric acid, or any combination of these can be used in such cases.

At 150, the method may include removing the solid phase from the slurry to obtain a lithium bicarbonate solution. The solid phase may be removed using at least one suitable solid-liquid separator, including but not limited to: a centrifuge, a filter (e.g., a filter press), a decanter, a sedimentation tank, a belt press, a cyclone separator or any combination thereof.

A final product may be obtained by reacting the lithium bicarbonate solution with an alkali carbonate to form lithium carbonate. In some examples, the alkali carbonate may comprise sodium carbonate, potassium carbonate, or any combination thereof.

A final product may also be obtained using direct lithium extraction (DLE) to convert the lithium bicarbonate solution into at least one lithium compound, which may comprise lithium hydroxide, lithium carbonate, lithium phosphate, lithium chloride, or any combination thereof. Non-limiting examples of suitable DLE methods include, but are not limited to, U.S. Pat. Nos. 11,396,452, 11,365,128, and 8,753,594, each of which is incorporated herein by reference in its entirety for all purposes.

In some examples, carbon dioxide is sequestered in residue from the processing of the mudstone ore. This carbon dioxide to be sequestered may be the supercritical carbon dioxide described by the present disclosure. In some embodiments, sequestering carbon dioxide could comprise sequestering emissions or waste from other sources. In some examples, the carbon dioxide is sequestered in the mudstone formation, as described below with reference to FIG. 2.

Figure 2:
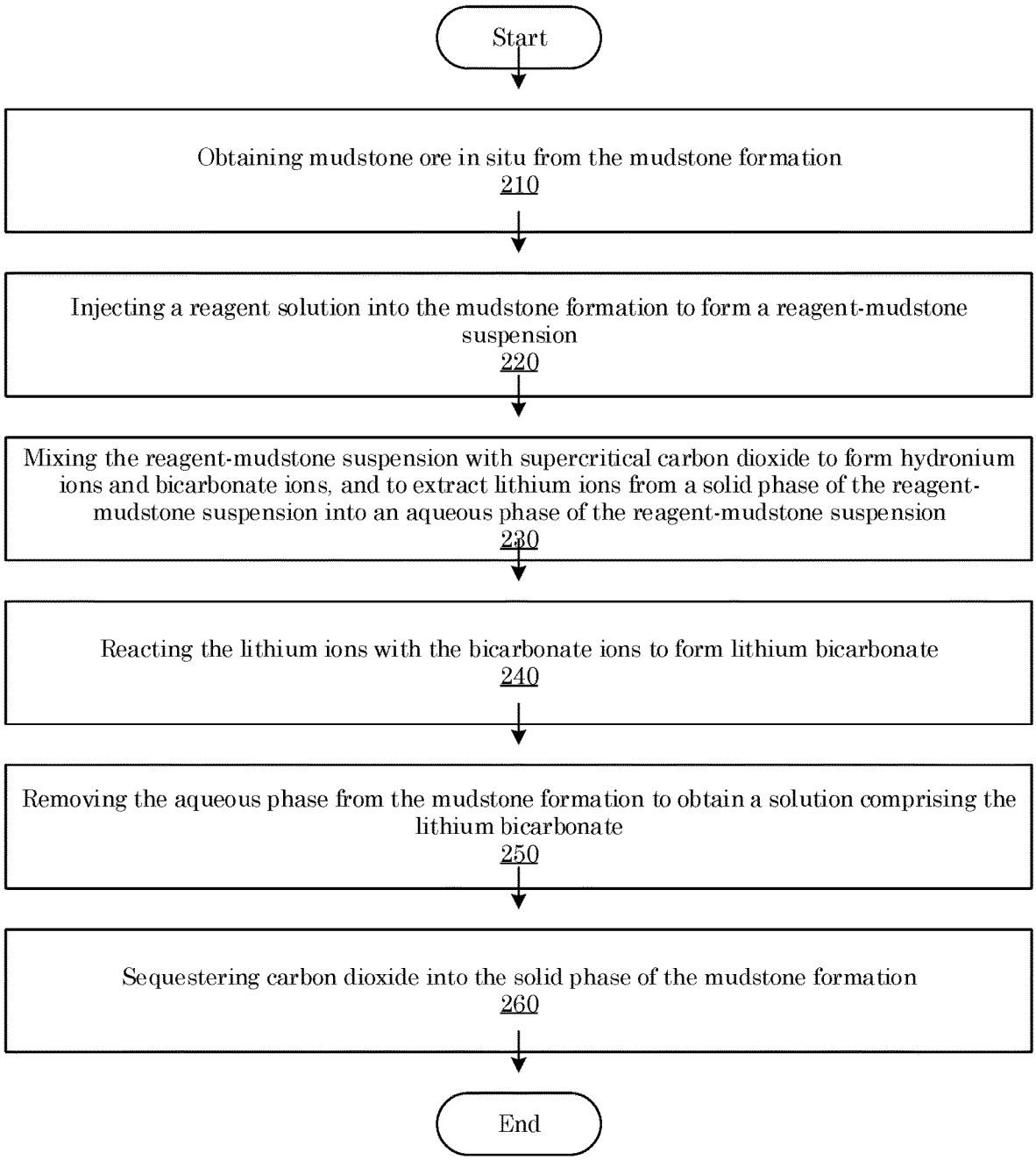
FIG. 2 is a flowchart illustrating a method for extracting lithium according to some embodiments of the present disclosure.

FIG. 2 is a flowchart that describes an example method for extracting lithium from a mudstone formation and sequestering carbon dioxide into the mudstone formation in situ, according to some embodiments of the present disclosure.

In some embodiments, at 210, the method may include obtaining mudstone ore in situ from the mudstone formation. The mudstone ore may be obtained in situ, by at least one technique chosen from explosive blasting, hydraulic fracturing, high-pressure jetting, chemical grouting, thermal fracturing, vibratory hammering, electro-hydraulic fracturing, laser fracturing, ultrasonic fracturing, or any combination thereof.

At 220, the method may include injecting a reagent solution into the mudstone formation to form a reagent-mudstone suspension. In some examples, the injection of the reagent solution may be performed using an injection well, such as, but not limited to, those used in the oil-and-gas industry for steam-assisted gravity drilling ("SAGD"). A non-limiting example of a suitable SAGD system is described in U.S. Pat. No. 7,824,453, which is incorporated by reference for all purposes. The reagent solution, in some embodiments, comprises sodium, potassium, magnesium, water, at least one acid, at least one base, or any combination thereof.

At 230, the method may include mixing the reagent-mudstone suspension with supercritical carbon dioxide to form hydronium ions and bicarbonate ions, and to extract lithium ions from a solid phase of the reagent-mudstone suspension into an aqueous phase of the reagent-mudstone suspension. Non-limiting methods of introducing supercritical carbon dioxide are described in U.S. Pat. Nos. 7,909,985 and 8,658,029, each of which is incorporated by reference for all purposes.

At 240, the mixing may include reacting the lithium ions with the bicarbonate ions to form lithium bicarbonate, as described above. As described above, the reaction may result in at least partial sequestration of the supercritical carbon dioxide via intercalation.

At 250, the method may include removing the aqueous phase from the mudstone formation to obtain a lithium bicarbonate solution. In some examples, the bicarbonate solution may be removed using a production well, such as, but not limited to, those used in the oil-and-gas industry for SAGD. Any remaining solids may be removed using at least one separator described above.

At 260, the method may include sequestering carbon dioxide into the solid phase of the mudstone formation. In some examples, at least some of the carbon dioxide may be sequestered during intercalation. In some examples, the carbon dioxide may be sequestered using known techniques for sequestering carbon dioxide in mudstone formations, such as, but not limited to, the techniques disclosed in US Patent Application Publication Nos. 2011/0030586 and 2013/0106117, each of which is incorporated by reference herein in its entirety for all purposes. In some embodiments, the carbon dioxide is sequestered into vacancies in a crystal structure of the mudstone, where the vacancies are formed by the intercalation described herein.

In certain examples, the mudstone formation is surrounded by a freeze wall, which may surround a predetermined volume of the mudstone formation. A non-limiting example of suitable freeze wall technology is described in United States Patent Application Publication No, 2011/0298270, which is incorporated by reference in its entirety for all purposes.

Figure 5:
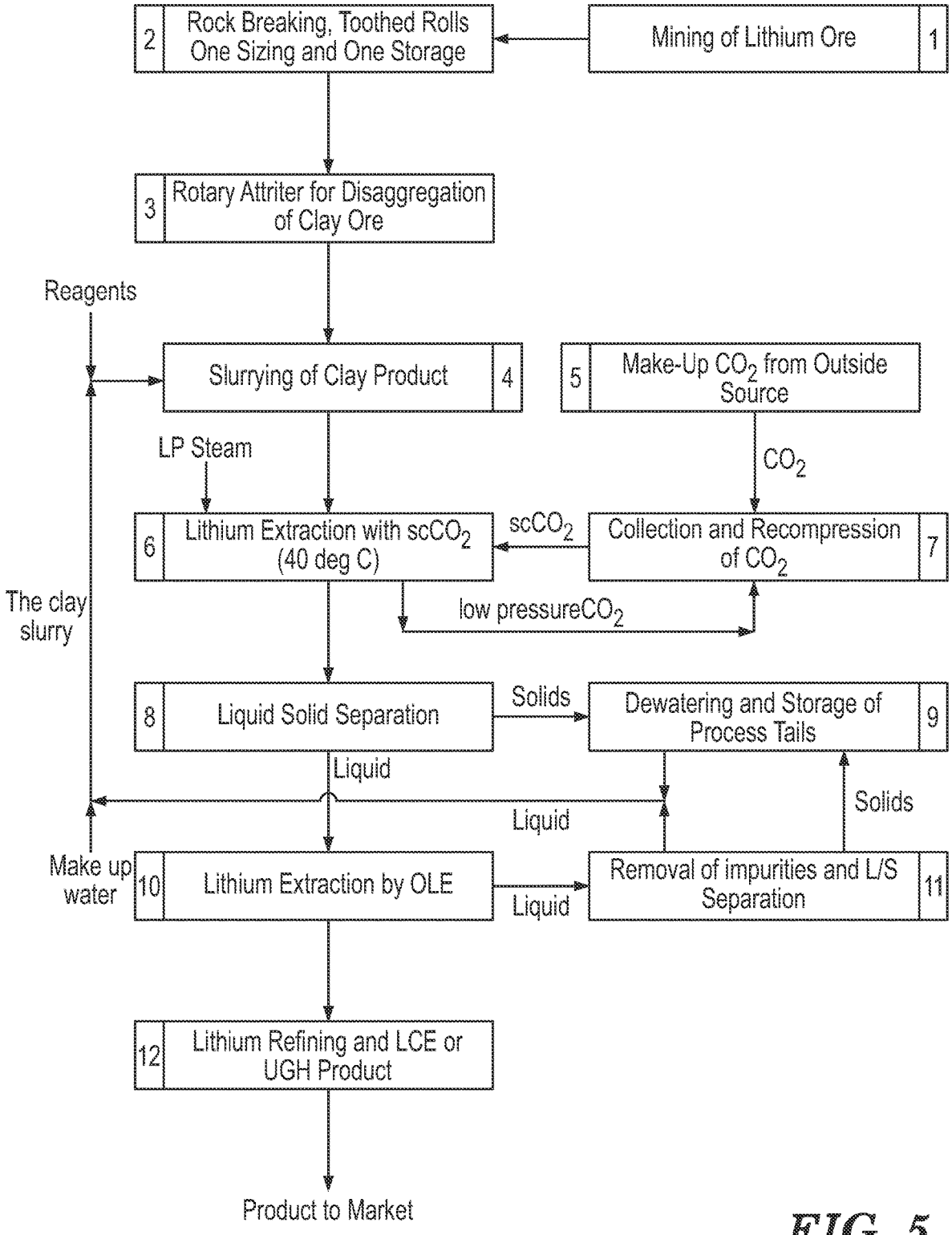
FIG. 5 is a process flow diagram that outlines a specific non-limiting example of a process employing at least one method according to the present disclosure.

As shown in FIG. 5 a specific non-limiting example of a process that employs at least one methods of the present disclosure may include the following steps: (1) mining lithium ore; (2) breaking, sizing, and/or storing the lithium ore; (3) disaggregating the clay ore using a rotary attritor to form a clay; (4) slurrying the clay product; (5) obtaining supercritical carbon dioxide, (6) extracting the lithium with the supercritical carbon dioxide, (7) recirculating supercritical carbon dioxide by recycling low-pressure carbon dioxide from the extraction step, recompressing the carbon dioxide to the supercritical phase, and reintroducing the carbon dioxide into the extraction step; (8) solid-liquid separation; (9) removal and storage of process tails, including removed solids, which can be reintroduced into the slurry in step 4; (10) lithium extraction; (11) removal of impurities which may be added to the process tails of step nine; (12) lithium refining to form a product.

The description and drawings described herein represent example configurations and do not represent all the implementations within the scope of the claims. For example, the operations and steps may be rearranged, combined, or modified. Also, structures and devices may be represented in block diagrams to represent the relationship between components and avoid obscuring the described concepts. Similar components or features may have the same name but may have different reference numbers corresponding to different figures.

Some modifications to the disclosure may be readily apparent to those skilled in the art, and the principles defined herein may be applied to other variations without departing from the scope of the disclosure. Thus, the disclosure is not limited to the examples and designs described herein but is to be accorded the broadest scope consistent with the principles and novel features disclosed herein. Among those benefits and improvements that have been disclosed, other objects and advantages of this disclosure will become apparent from the following description taken in conjunction with the accompanying figures. Detailed embodiments of the present disclosure are disclosed herein; however, it is to be understood that the disclosed embodiments are merely illustrative of the disclosure that may be embodied in various forms. In addition, each of the examples given regarding the various embodiments of the disclosure which are intended to be illustrative, and not restrictive.

In this disclosure and the following claims, the word "or" indicates an inclusive list such that, for example, the list of X, Y, or Z means X or Y or Z or XY or XZ or YZ or XYZ. Also the phrase "based on" is not used to represent a closed set of conditions. For example, a step that is described as "based on condition A" may be based on both condition A and condition B. In other words, the phrase "based on" shall be construed to mean "based at least in part on." Also, the words "a" or "an" indicate "at least one."

Throughout the specification and claims, the following terms take the meanings explicitly associated herein, unless the context clearly dictates otherwise. The phrases "in one embodiment," "in an embodiment," and "in some embodiments" as used herein do not necessarily refer to the same embodiment(s), though it may. Furthermore, the phrases "in another embodiment" and "in some other embodiments" as used herein do not necessarily refer to a different embodiment, although it may. All embodiments of the disclosure are intended to be combinable without departing from the scope or spirit of the disclosure.

As used herein, the term "based on" is not exclusive and allows for being based on additional factors not described, unless the context clearly dictates otherwise. In addition, throughout the specification, the meaning of "a," "an," and "the" include plural references. The meaning of "in" includes "in" and "on."

All prior patents, publications, and test methods referenced herein are incorporated by reference in their entireties.

Variations, modifications and alterations to embodiments of the present disclosure described above will make themselves apparent to those skilled in the art. All such variations, modifications, alterations and the like are intended to fall within the spirit and scope of the present disclosure, limited solely by the appended claims.

Any feature or element that is positively identified in this description may also be specifically excluded as a feature or element of an embodiment of the present disclosure as defined in the claims.

As used herein, the term "consisting essentially of" limits the scope of a specific claim to the specified materials or steps and those that do not materially affect the basic and novel characteristic or characteristics of the specific claim.

The disclosure described herein may be practiced in the absence of any element or elements, limitation or limitations, which is not specifically disclosed herein. Thus, for example, in each instance herein, any of the terms "comprising," "consisting essentially of and "consisting of" may be replaced with either of the other two terms. The terms and expressions which have been employed are used as terms of description and not of limitation, and there is no intention in the use of such terms and expressions of excluding any equivalents of the features shown and described or portions thereof, but it is recognized that various modifications are possible within the scope of the disclosure.

The invention claimed is:

1. A method for extracting lithium from a mudstone ore, the method comprising:

obtaining the mudstone ore;

combining the mudstone ore with a reagent solution to obtain a slurry;

mixing the slurry with supercritical carbon dioxide to form hydronium ions and bicarbonate ions, thereby extracting lithium ions from a solid phase of the slurry into an aqueous phase of the slurry;

reacting the lithium ions with the bicarbonate ions to form lithium bicarbonate; and removing the solid phase from the slurry to obtain a lithium bicarbonate solution.

2. The method of claim 1, where the lithium ions are extracted from a solid phase of the slurry into an aqueous phase of the slurry by leaching or intercalation.

3. The method of claim 1, where the mudstone ore has an average particle size of 1 to 500 microns.

4. The method of claim 1, where the mudstone ore is obtained by:

mining mudstone; and defragmenting the mudstone to form the mudstone ore.

5. The method of claim 4, where defragmenting the mudstone to form the mudstone ore comprises:

breaking the mudstone to form the mudstone ore;

disaggregating the mudstone ore.

6. The method of claim 1, where the reagent solution comprises sodium, potassium, magnesium, water, an acid, a base, or any combination thereof.

7. The method of claim 1, further comprising preheating the slurry to a temperature of 45° C. to 95° C. prior to mixing the slurry with supercritical carbon dioxide.

8. The method of claim 1, where mixing the slurry with supercritical carbon dioxide is performed for 15 minutes to 240 minutes.

9. The method of claim 1, where the slurry is maintained at a temperature of at least 32° C. and at least 75 bar.

10. The method of claim 1, further comprising reacting the lithium bicarbonate solution with an alkali carbonate to form lithium carbonate.

11. The method of claim 1 further comprising using direct lithium extraction (DLE) to convert the lithium bicarbonate solution into at least one lithium compound.

12. The method of claim 11, where the at least one lithium compound is lithium hydroxide, lithium carbonate, lithium phosphate, lithium chloride, or any combination thereof.

13. The method of claim 1, where the method is performed in situ.

14. The method of claim 1, further comprising sequestering carbon dioxide into the solid phase after removal from the slurry.

15. A method for extracting lithium from a mudstone formation and sequestering carbon dioxide into the mudstone formation in situ, the method comprising:

obtaining mudstone ore in situ from the mudstone formation;

injecting a reagent solution into the mudstone formation to form a reagent-mudstone suspension;

mixing the reagent-mudstone suspension with supercritical carbon dioxide to form hydronium ions and bicarbonate ions, and to extract lithium ions from a solid phase of the reagent-mudstone suspension into an aqueous phase of the reagent-mudstone suspension;

reacting the lithium ions with the bicarbonate ions to form lithium bicarbonate;

removing the aqueous phase from the mudstone formation to obtain a solution comprising the lithium bicarbonate;

sequestering the carbon dioxide into the solid phase of the mudstone formation.

16. The method of claim 15, where the reagent solution comprises sodium, potassium, magnesium, water, at least one acid, at least one base, or any combination thereof.

17. The method of claim 15, where the mudstone formation is surrounded by a freeze wall.

18. The method of claim 17, where the freeze wall surrounds a predetermined volume of the mudstone formation.

19. The method of claim 15, where the lithium ions are extracted from a solid phase of the reagent-mudstone suspension into an aqueous phase of the reagent-mudstone suspension by intercalation.

* * * * *